US011965284B2

(12) United States Patent
Lewis

(10) Patent No.: US 11,965,284 B2
(45) Date of Patent: Apr. 23, 2024

(54) CLOTHING IRONING ASSEMBLY

(71) Applicant: Donte Lewis, Concord, CA (US)

(72) Inventor: Donte Lewis, Concord, CA (US)

( * ) Notice: Subject to any disclaimer, the term of this patent is extended or adjusted under 35 U.S.C. 154(b) by 121 days.

(21) Appl. No.: 17/845,484

(22) Filed: Jun. 21, 2022

(65) Prior Publication Data

US 2023/0407553 A1 Dec. 21, 2023

(51) Int. Cl.
*D06F 75/20* (2006.01)
*D06F 75/28* (2006.01)
*D06G 1/00* (2006.01)

(52) U.S. Cl.
CPC ..... *D06F 75/20* (2013.01); *D06F 75/28* (2013.01); *D06G 1/00* (2013.01)

(58) Field of Classification Search
CPC ..... D06F 75/00; D06F 75/40; D06G 1/00
See application file for complete search history.

(56) References Cited

U.S. PATENT DOCUMENTS 643,717 A * 2/1900 Ingalsbe ..... B23D 71/00 407/29.15
1,868,170 A * 7/1932 Jasgur ..... D06C 29/00 38/77.1
2,162,354 A * 6/1939 Newman ..... D06F 75/22 239/289
2,458,530 A * 1/1949 Resnick ..... D06F 75/30 15/105
2,786,287 A * 3/1957 Swann ..... D06F 75/14 38/77.4
3,604,490 A * 9/1971 Bricker ..... B26D 1/29 241/273.3
3,805,425 A * 4/1974 Spoida ..... D06F 87/00 392/404
3,823,498 A 7/1974 Davidson
4,788,769 A 12/1988 Maruyama
5,799,422 A * 9/1998 Demuth ..... D06F 75/38 38/93
6,314,668 B1 * 11/2001 Daulasim ..... C02F 5/125 38/77.8
6,986,217 B2 * 1/2006 Leung ..... D06F 73/00 68/222
D544,165 S 6/2007 Massip
7,661,212 B2 * 2/2010 Hahn ..... D06F 87/00 38/81
D679,909 S * 4/2013 Wales ..... D4/124
9,915,024 B2 * 3/2018 Chua ..... D06F 75/38
D828,626 S 9/2018 Hsu
10,337,132 B1 7/2019 Mathis
(Continued)

FOREIGN PATENT DOCUMENTS

EP 3064639 A1 * 9/2016 ..... B01D 29/01

*Primary Examiner* — Ismael Izaguirre

(57) ABSTRACT

A clothing ironing assembly for removing lint from fabric includes a steam iron that has a lint chamber is integrated into the steam iron. The steam iron has a sole plate and the sole plate has a plurality of steam openings each extending through the sole plate. The steam iron has a plurality of scraping elements each integrated into the sole plate to scrape lint from a fabric when the sole plate is rubbed across the fabric while ironing the fabric. Each of the scraping elements directs the lint into the lint chamber collect the lint. A lint screen is removably insertable into the lint opening to collect the lint directed into the lint chamber.

10 Claims, 5 Drawing Sheets

(56) References Cited

U.S. PATENT DOCUMENTS

| | | | | |
|---|---|---|---|---|
| 2005/0132575 | A1 | 6/2005 | Chen | |
| 2005/0278988 | A1* | 12/2005 | Fernandez | D06F 75/14 38/81 |
| 2011/0107626 | A1* | 5/2011 | Mandica | D06F 75/38 38/93 |
| 2012/0011670 | A1 | 1/2012 | Ayediran | |

* cited by examiner

CLOTHING IRONING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ironing devices and more particularly pertains to a new ironing device for removing lint from fabric. The device includes a steam iron that has a plurality of scraping elements each integrated into a sole plate of the steam iron to scrap lint from fabric that is being ironed. The steam iron includes a lint chamber that receives the lint from the scraping elements and a lint screen that collects the lint. The lint screen is removable from the steam iron for removing lint from the lint screen.

(2) Description of Related Art Including Information Disclosed Under 37 CFR 1.97 and 1.98

The prior art relates to ironing devices including a self cleaning steam iron for directing a large amount of water onto a soleplate of the steam iron. The prior art discloses a variety of lint removing tools which each includes a rotating blade and a containment chamber for lint. The prior art discloses a lint removal tool that includes a scraping blade disposed on a handle. The prior art discloses a lint removal device that includes a steam iron, a coupler that engages the steam iron and a lint removal unit that is attachable to the coupler.

BRIEF SUMMARY OF THE INVENTION

An embodiment of the disclosure meets the needs presented above by generally comprising a steam iron that has a lint chamber is integrated into the steam iron. The steam iron has a sole plate and the sole plate has a plurality of steam openings each extending through the sole plate. The steam iron has a plurality of scraping elements each integrated into the sole plate to scrape lint from a fabric when the sole plate is rubbed across the fabric while ironing the fabric. Each of the scraping elements directs the lint into the lint chamber collect the lint. A lint screen is removably insertable into the lint opening to collect the lint directed into the lint chamber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
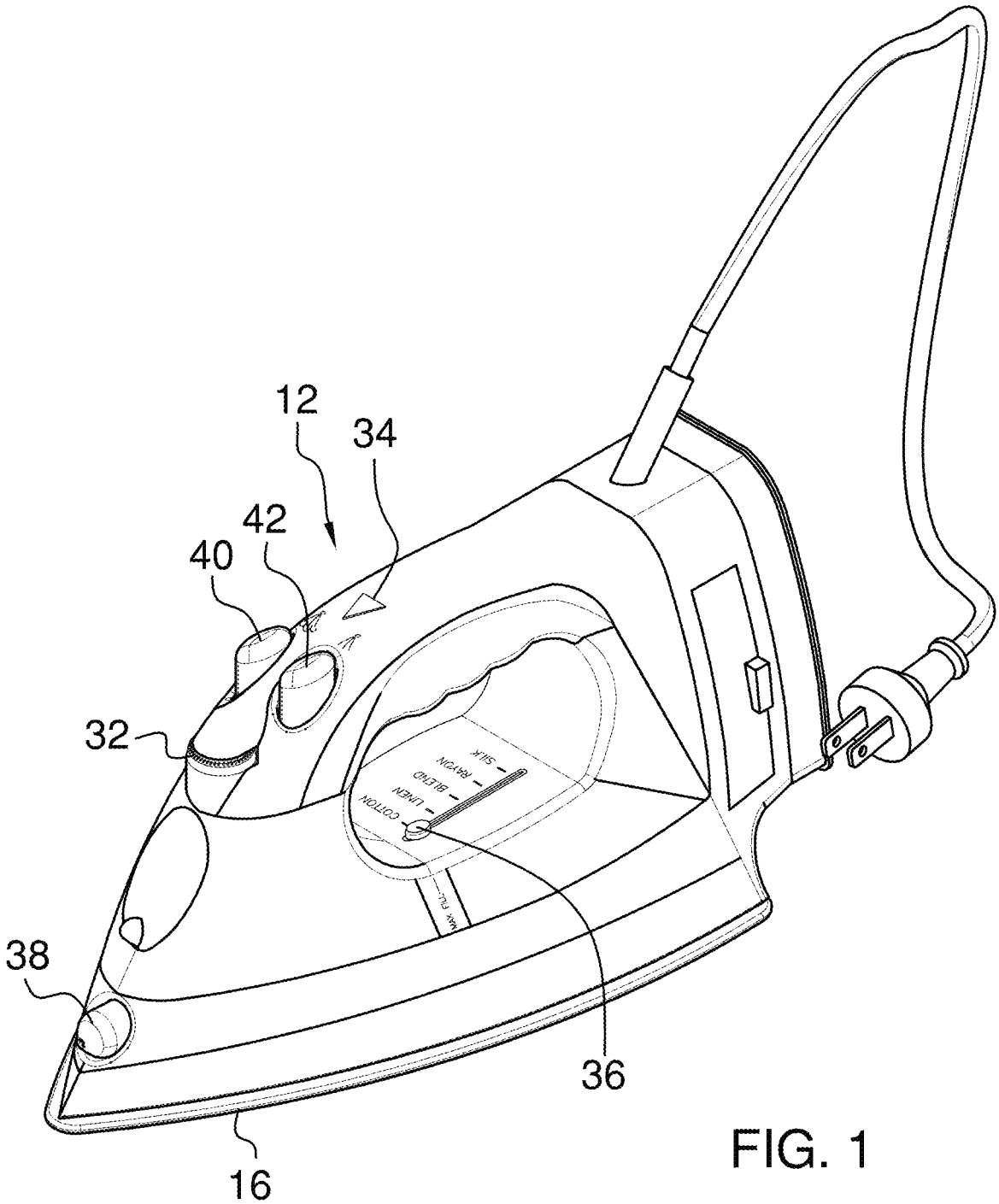
FIG. 1 is a top perspective view of a clothing ironing assembly according to an embodiment of the disclosure.
Figure 2:
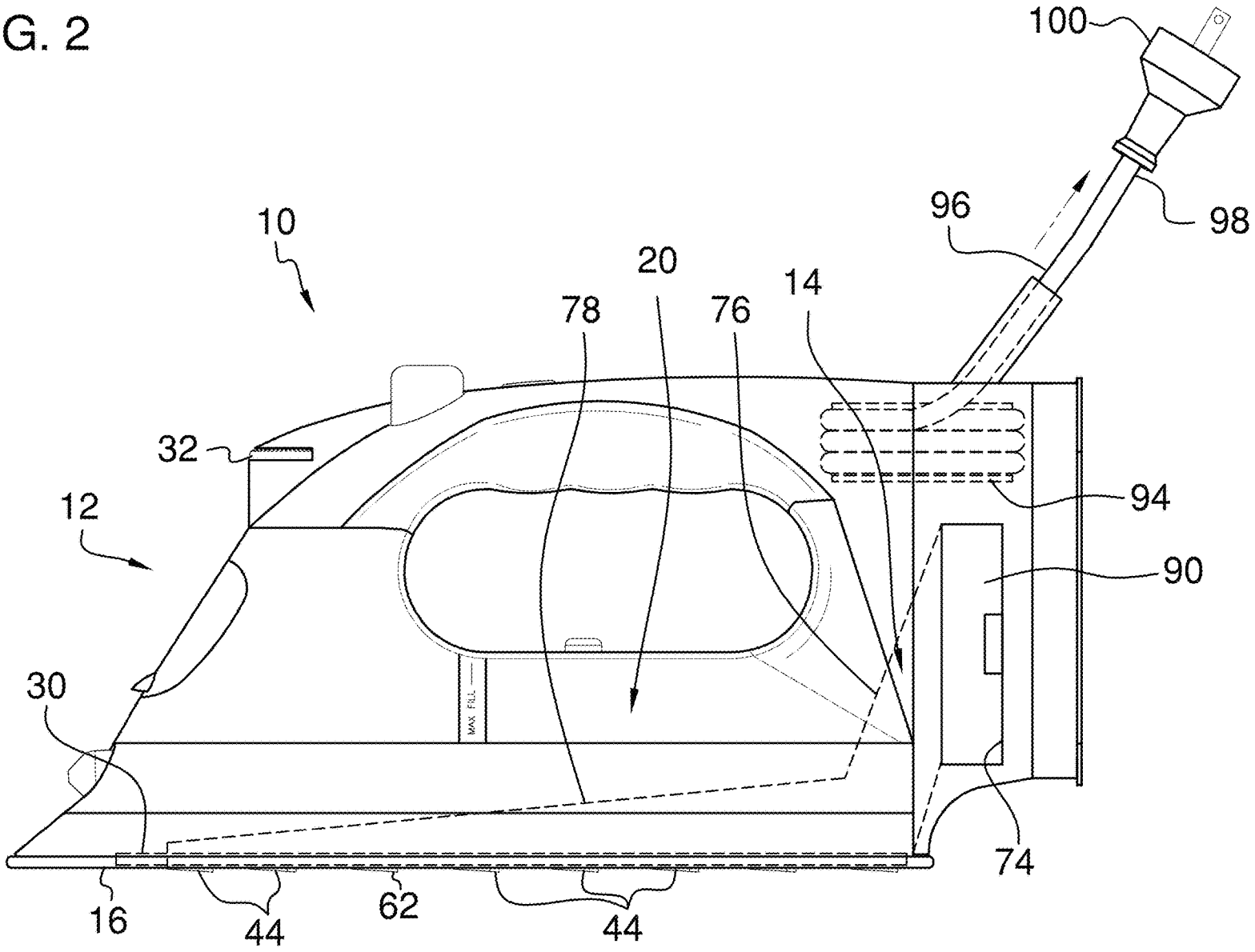
FIG. 2 is a left side phantom view of an embodiment of the disclosure.
Figure 3:
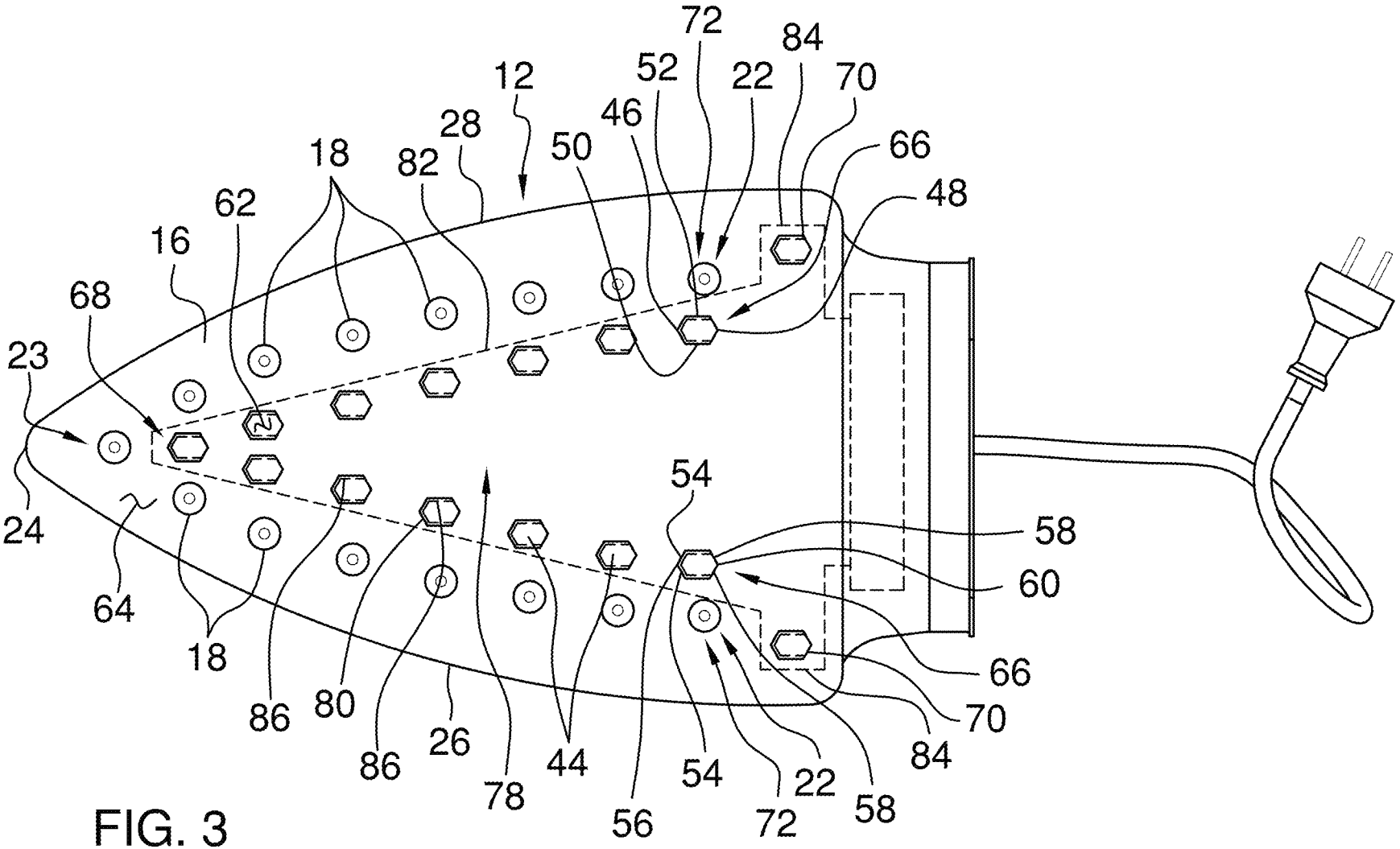
FIG. 3 is a bottom phantom view of an embodiment of the disclosure.
Figure 4:
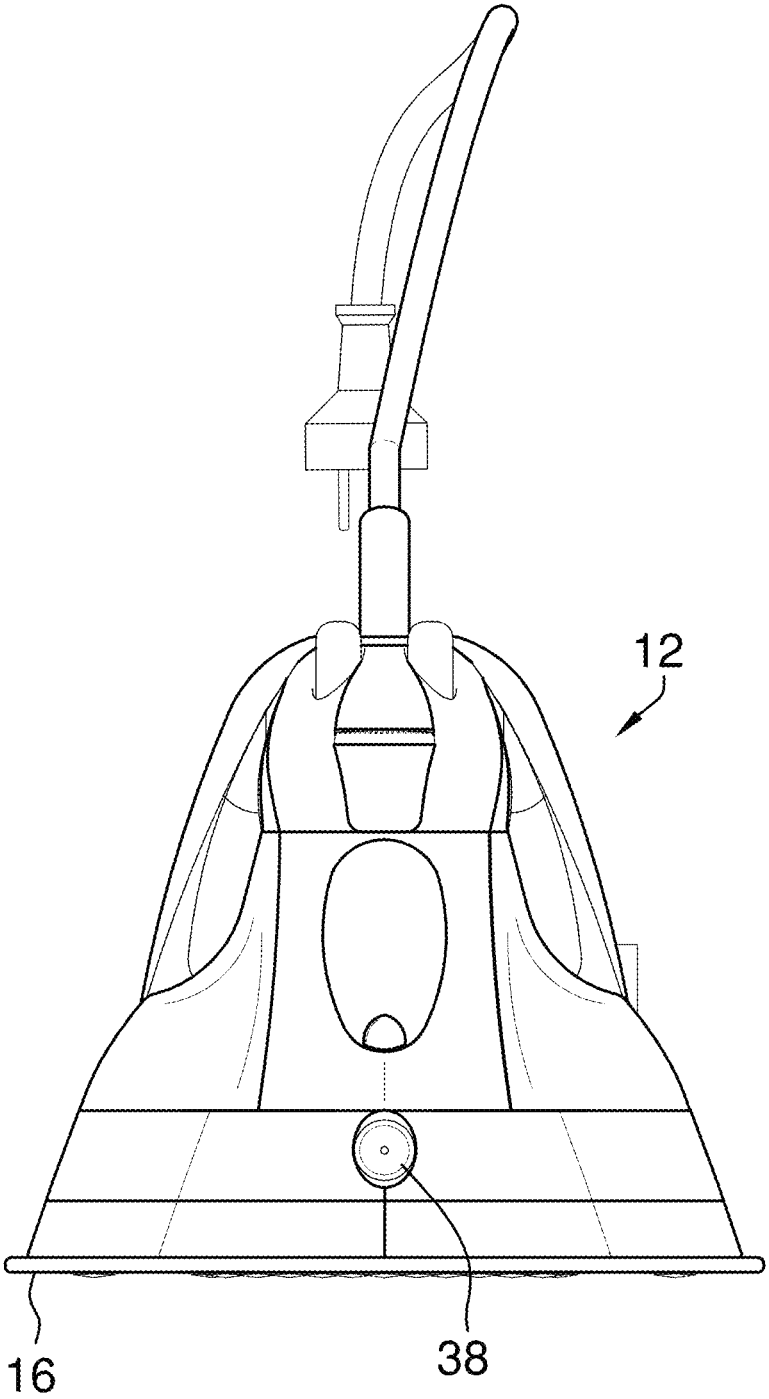
FIG. 4 is a front view of an embodiment of the disclosure.
Figure 5:
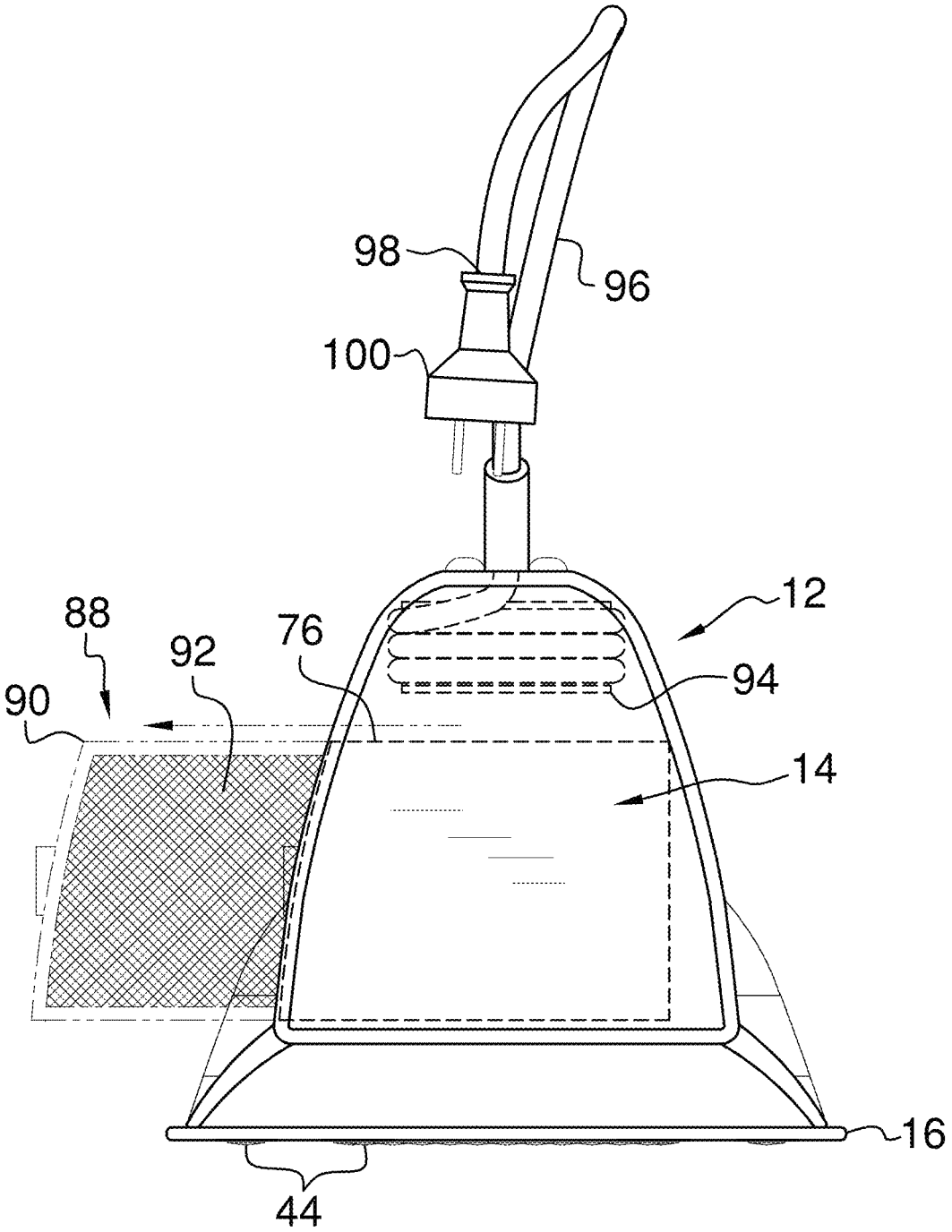
FIG. 5 is a back phantom view of an embodiment of the disclosure.

With reference now to the drawings, and in particular to FIGS. 1 through 5 thereof, a new ironing device embodying the principles and concepts of an embodiment of the disclosure and generally designated by the reference numeral 10 will be described.

As best illustrated in FIGS. 1 through 5, the clothing ironing assembly 10 generally comprises a steam iron 12 that has a lint chamber 14 which is integrated into the steam iron 12. The steam iron 12 has a sole plate 16 and the sole plate 16 has a plurality of steam openings 18 each extending through the sole plate 16. A fluid reservoir is integrated into the steam iron 12 to contain a fluid, such as water, and the fluid reservoir 20 is in fluid communication with each of the steam openings 18 such that each of the steam openings 18 receives the fluid. The plurality of steam openings 18 is arranged in a pair of lines 22 on the sole plate 16 and each of the lines 22 intersects at a point 23 located adjacent to a front end 24 of the sole plate 16. The pair of lines 22 angle away from each other along a respective first lateral edge 26 and the second lateral edge 28 of the sole plate 16.

A heating element 30 is integrated into the steam iron 12 and the heating element is in thermal communication with the sole plate 16 such that the heating element 30 heats the sole plate 16 when the heating element 30 is turned on. In this way the sole plate 16 can boil the fluid delivered to the steam openings 18 thereby facilitating each of the steam openings 18 to release steam produced from the boiling fluid. The heating element 30 may comprise an electric heating coil or the like and the heating element 30 may have an operational temperature in excess of 210.0 degrees Fahrenheit. The steam iron 12 includes a variety of controls that are common to steam irons, including but not being limited to, a temperature knob 32 for adjusting a temperature of the heating element a light emitter 34 for indicating when the heating element 30 is turned on and a fabric selector 36 that is slidably integrated into the steam iron 12 for selecting various types of fabric to be ironed. Additionally, the steam iron 12 may include a spray nozzle 38 disposed on a nose of the steam iron 12, a fluid pumping button 40 and a steam pumping button 42 for pumping either fluid or steam outwardly from the spray nozzle 38.

The steam iron 12 has a plurality of scraping elements 44 that is each integrated into the sole plate 16 to scrape lint from a fabric when the sole plate 16 is rubbed across the fabric for ironing the fabric. Each of the scraping elements 44 is in communication with the lint chamber 14 thereby facilitating the lint chamber 14 to collect the lint scraped by the plurality of scraping elements 44. Each of the scraping elements 44 has a front end 46, a back end 48, a first lateral side 50 and a second lateral side 52. The front end 46 has pair of intersecting sides 54 each extending between a respective one of the first lateral side 50 and the second lateral side 52 and a point 56 defined by the pair of intersecting sides 54. Additionally, the back end 48 has a pair of intersecting sides 58 each extending between a respective one of the first lateral side 50 and the second lateral side 52 and a point 60 defined by the pair of intersecting sides 58 of the back end 48 such that each of the scraping elements 44 has a hexagonal shape.

Each of the scraping elements 44 has a distal surface 62 with respect to a bottom surface 64 of the sole plate 16. The distal surface 62 of each of the scraping elements 44 slopes away from the bottom surface 64 between the front end 46 and the back end 48 of the scraping elements 44. Furthermore, the distal surface 62 of each of the scraping elements 44 intersects the bottom surface 64 of the sole plate 16 at the front end 46 of the scraping elements 44. The plurality of scraping elements 44 is arranged in a pair of lines 66 and each of the lines 66 of the scraping elements 44 intersects each other at a point 68 located adjacent to the point 23 defined by the lines 22 of the steam openings 18. Each of the lines 66 defined by the scraping elements 44 angles away from each other and extends along a respective one of the lines 22 defined by the steam openings 18.

The plurality of scraping elements 44 includes a pair of terminal scraping elements 70. Each of the terminal scraping elements 70 is positioned adjacent to a terminal end 72 of a respective one of the lines 22 defined by the steam openings 18. The steam iron 12 has a lint opening 74 extending through a heel 75 of the steam iron 12 and the lint opening 74 extends into the lint chamber 14. The lint chamber 14 has a first portion 76 which forms an angle with a second portion 78. The first portion 76 angles downwardly between the lint opening 74 and the second portion 78. The second portion 78 extends forwardly from the first portion 76 and the second portion 78 extends along a substantial length of the sole plate 16.

The second portion 78 has a first lateral bounding wall 80 and a second lateral bounding wall 82. Each of the first lateral bounding wall 80 and the second lateral bounding wall 82 extends between a respective pair of the lines 22 defined by the steam openings 18 and the lines 66 defined by the scraping elements 44 such that each of the scraping elements 44 is positioned below the second portion 78 of the lint chamber 14. Each of the first lateral bounding wall 80 and the second lateral bounding wall 82 has a kicked out portion 84 extending around a respective one of the terminal scraping elements 70. The sole plate 16 has a plurality of lint holes 86 each extending through the sole plate 16 and into the second portion 78 of the lint chamber 14. Each of the lint holes 86 extends along the intersecting sides 54 of the front end 46 of a respective one of the scraping elements 44 and the first lateral side 50 and the second lateral side 52 of the respective scraping element 44 to direct the lint into the lint chamber 14.

A lint screen 88 is removably insertable into the lint opening 74 to collect the lint that is directed into the lint chamber 14. The lint screen 88 includes a frame 90 and a mesh panel 92 that is integrated into the frame 90. The mesh panel 92 is comprised of a fluid permeable material to facilitate air to pass through the mesh panel 92 to collect the lint on the mesh panel 92. A retracting spool 94 is rotatably disposed within the steam iron 12. The retracting spool 94 is biased to rotate in a first direction and the retracting spool 94 is urgeable to rotate in a second direction.

A power cord 96 is wrapped around the retracting spool 94 and the power cord 96 extends outwardly through the heel 75 of the steam iron 12. The power cord 96 has a distal end 98 that is exposed with respect to the steam iron 12 and a male plug 100 is electrically coupled to the distal end 98. The power cord 96 is electrically coupled to the heating element 30 and the power cord 96 is retracted into the heel of the steam iron 12 when the retracting spool 94 rotates in the first direction. Furthermore, the retracting spool 94 rotates in the second direction when the power cord 96 is pulled outwardly from the heel.

In use, the steam iron 12 is employed in the tradition convention of steam irons with respect to ironing articles of the clothing or other fabric items. Each of the scraping elements 44 removes lint from the article of clothing as the sole plate 16 is moved along the article of clothing. Furthermore, the lint travels through the lint chamber 14 unit the lint is collected on the lint screen 88. The lint screen 88 is removed from the lint opening 74 to facilitate the lint to be cleaned from the lint screen 88. The lint screen 88 is inserted into the lint opening 74 when the lint screen 88 has been cleaned.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A clothing ironing assembly having scraping elements for scraping lint from an article of clothing, said assembly comprising:

a steam iron having a lint chamber being integrated into said steam iron, said steam iron having a sole plate, said sole plate having a plurality of steam openings each extending through said sole plate, said steam iron having a plurality of scraping elements each being integrated into said sole plate wherein each of said scraping elements is configured to scrape lint from a fabric when said sole plate is rubbed across the fabric for ironing the fabric, each of said scraping elements being in communication with said lint chamber wherein said lint chamber is configured to collect the lint scraped by said plurality of scraping elements, said steam iron has a lint opening extending through a heel of said steam iron, said lint opening extending into said lint chamber; and a lint screen being removably insertable into said lint opening wherein said lint screen is configured to collect the lint directed into said lint chamber.

2. The assembly according to claim 1, wherein each of said scraping elements has a front end, a back end, a first lateral side and a second lateral side, said front end having pair of intersecting sides each extending between a respective one of said first lateral side and said second lateral side and a point defined by said pair of intersecting sides, said back end having a pair of intersecting sides each extending between a respective one of said first lateral side and said second lateral side and a point defined by said pair of intersecting sides of said back end such that each of said scraping elements has a hexagonal shape.

3. The assembly according to claim 2, wherein each of said scraping elements has a distal surface with respect to a bottom surface of said sole plate, said distal surface of each of said scraping elements sloping away from said bottom surface between said front end and said back end of said scraping elements such that said distal surface of each of said scraping elements intersects said bottom surface of said sole plate at said front end of said scraping elements.

4. The assembly according to claim 1, wherein:

said plurality of steam openings is arranged in a pair of lines on said sole plate, each of said lines intersecting at a point located adjacent to a front end of said sole plate, said pair of lines angling away from each other along a respective first lateral edge and said second lateral edge of said sole plate;

said plurality of scraping elements is arranged in a pair of lines, each of said lines of said scraping elements intersecting each other at a point located adjacent to said point defined by said lines of said steam openings, each of said lines defined by said scraping elements angling away from each other and extending along a respective one of said lines defined by said steam openings; and said plurality of scraping elements includes a pair of terminal scraping elements, each of said terminal scraping elements being positioned adjacent to a terminal end of a respective one of said lines defined by said steam openings.

5. The assembly according to claim 4, wherein:

said lint chamber has a first portion forming an angle with a second portion, said first portion angling downwardly between said opening and said second portion, said second portion extending forwardly from said first portion, said second portion extending along a substantial length of said sole plate; and said second portion has a first lateral bounding wall and a second lateral bounding wall, each of said first lateral bounding wall and said second lateral bounding wall extending between a respective pair of said lines defined by said steam openings and said scraping elements such that each of said scraping elements is positioned below said second portion of said lint chamber.

6. The assembly according to claim 5, wherein each of said first lateral bounding wall and said second lateral bounding wall has a kicked out portion extending around a respective one of said terminal scraping elements.

7. The assembly according to claim 5, wherein:

each of said scraping elements has a front end, a back end, a first lateral side and a second lateral side, said front end having pair of intersecting sides each extending between a respective one of said first lateral side and said second lateral side and a point defined by said pair of intersecting sides, said back end having a pair of intersecting sides each extending between a respective one of said first lateral side and said second lateral side and a point defined by said pair of intersecting sides of said back end such that each of said scraping elements has a hexagonal shape; and said sole plate has a plurality of lint holes each extending through said sole plate and into said second portion of said lint chamber, each of said lint holes extending along said intersecting sides of said front end of a respective one of said scraping elements and said first lateral side and said second lateral side of said respective scraping element wherein each of said lint holes is configured to direct the lint into said lint chamber.

8. The assembly according to claim 1, further comprising:

a retracting spool being rotatably disposed within said steam iron, said retracting spool being biased to rotate in a first direction, said retracting spool being urgeable to rotate in a second direction; and a power cord being wrapped around said retracting spool, said power cord extending outwardly through said heel of said steam iron, said power cord having a distal end being exposed with respect to said steam iron, said power cord having a male plug being electrically coupled to said distal end, said power cord being electrically coupled to said heating element, said power cord being retracted into said heel of said steam iron when said retracting spool rotates in said first direction, said retracting spool rotating in said second direction when said power cord is pulled outwardly from said heel.

9. The assembly according to claim 1, wherein said lint screen includes a frame and a mesh panel being integrated into said frame, said mesh panel being comprised of a fluid permeable material wherein said mesh panel is configured to facilitate air to pass through said mesh panel to collect the lint on said mesh panel.

10. A clothing ironing assembly having scraping elements for scraping lint from an article of clothing, said assembly comprising:

a steam iron having a lint chamber being integrated into said steam iron, said steam iron having a sole plate, said sole plate having a plurality of steam openings each extending through said sole plate, said steam iron having a fluid reservoir being integrated into said steam iron wherein said fluid reservoir is configured to contain a fluid, said fluid reservoir being in fluid communication with each of said steam openings wherein each of said steam openings is configured to receive the fluid, said plurality of steam openings being arranged in a pair of lines on said sole plate, each of said lines intersecting at a point located adjacent to a front end of said sole plate, said pair of lines angling away from each other along a respective first lateral edge and said second lateral edge of said sole plate, said steam iron having a heating element being integrated into said steam iron, said heating element being in thermal communication with said sole plate such that said heating element heats said sole plate when said heating element is turned on wherein said sole plate is configured to boil the fluid delivered to said steam openings thereby facilitating each of said steam openings to release steam produced from the boiling fluid, said steam iron having a plurality of scraping elements each being integrated into said sole plate wherein each of said scraping elements is configured to scrape lint from a fabric when said sole plate is rubbed across the fabric for ironing the fabric, each of said scraping elements being in communication with said lint chamber wherein said lint chamber is configured to collect the lint scraped by said plurality of scraping elements, each of said scraping elements having a front end, a back end, a first lateral side and a second lateral side, said front end having pair of intersecting sides each extending between a respective one of said first lateral side and said second lateral side and a point defined by said pair of intersecting sides, said back end having a pair of intersecting sides each extending between a respective one of said first lateral side and said second lateral side and a point defined by said pair of intersecting sides of said back end such that each of said scraping elements has a hexagonal shape, each of said scraping elements having a distal surface with respect to a bottom surface of said sole plate, said distal surface of each of said scraping elements sloping away from said bottom surface between said front end and said back end of said scraping elements such that said distal surface of each of said scraping elements intersects said bottom surface of said sole plate at said front end of said scraping elements, said plurality of scraping elements being arranged in a pair of lines, each of said lines of said scraping elements intersecting each other at a point located adjacent to said point defined by said lines of said steam openings, each of said lines defined by said scraping elements angling away from each other and extending along a respective one of said lines defined by said steam openings, said plurality of scraping elements including a pair of terminal scraping elements, each of said terminal scraping elements being positioned adjacent to a terminal end of a respective one of said lines defined by said steam openings, said steam iron having a lint opening extending through a heel of said steam iron, said lint opening extending into said lint chamber, said lint chamber having a first portion forming an angle with a second portion, said first portion angling downwardly between said opening and said second portion, said second portion extending forwardly from said first portion, said second portion extending along a substantial length of said sole plate, said second portion having a first lateral bounding wall and a second lateral bounding wall, each of said first lateral bounding wall and said second lateral bounding wall extending between a respective pair of said lines defined by said steam openings and said scraping elements such that each of said scraping elements is positioned below said second portion of said lint chamber, each of said first lateral bounding wall and said second lateral bounding wall having a kicked out portion extending around a respective one of said terminal scraping elements, said sole plate having a plurality of lint holes each extending through said sole plate and into said second portion of said lint chamber, each of said lint holes extending along said intersecting sides of said front end of a respective one of said scraping elements and said first lateral side and said second lateral side of said respective scraping element wherein each of said lint holes is configured to direct the lint into said lint chamber;

a lint screen being removably insertable into said lint opening wherein said lint screen is configured to collect the lint directed into said lint chamber, said lint screen including a frame and a mesh panel being integrated into said frame, said mesh panel being comprised of a fluid permeable material wherein said mesh panel is configured to facilitate air to pass through said mesh panel to collect the lint on said mesh panel;

a retracting spool being rotatably disposed within said steam iron, said retracting spool being biased to rotate in a first direction, said retracting spool being urgeable to rotate in a second direction; and a power cord being wrapped around said retracting spool, said power cord extending outwardly through said heel of said steam iron, said power cord having a distal end being exposed with respect to said steam iron, said power cord having a male plug being electrically coupled to said distal end, said power cord being electrically coupled to said heating element, said power cord being retracted into said heel of said steam iron when said retracting spool rotates in said first direction, said retracting spool rotating in said second direction when said power cord is pulled outwardly from said heel.

* * * * *